United States Patent [19]

Licari

[11] Patent Number: 4,488,650

[45] Date of Patent: Dec. 18, 1984

[54] ADJUSTABLE RACK FOR HANGING ARTICLES

[76] Inventor: Vito Licari, 875 Ocean Ave., Elberon, N.J. 07740

[21] Appl. No.: 444,083

[22] Filed: Nov. 24, 1982

[51] Int. Cl.[3] ..... A47F 5/08

[52] U.S. Cl. ..... 211/105; 248/277; 403/163

[58] Field of Search ..... 211/104, 202, 105, 195, 211/96, 168, 170; 403/154, 155, 162, 163; 248/277, 167, 291; 411/338, 339

[56] References Cited

U.S. PATENT DOCUMENTS

| | | | |
|---|---|---|---|
| 132,692 | 10/1872 | Roddy . | |
| 1,372,327 | 3/1921 | Young | 403/162 X |
| 1,952,494 | 3/1934 | Gafford . | |
| 1,994,897 | 3/1935 | Owen | 211/105 |
| 2,493,936 | 1/1950 | Williams | 211/105 |
| 3,337,060 | 8/1967 | Atweger | 211/105 |
| 3,967,803 | 7/1976 | Kienlen et al. | 248/346 X |
| 4,287,993 | 9/1981 | Licari | 211/105 |
| 4,364,480 | 12/1982 | Ohno | 211/105 X |

FOREIGN PATENT DOCUMENTS

| | | | |
|---|---|---|---|
| 482853 | 2/1917 | France | 411/339 |

*Primary Examiner*—Robert W. Gibson, Jr.

[57] ABSTRACT

An adjustable rack includes a plurality of hook members for hanging articles therefrom. The hook members are attached to a jointed frame from frame members which are pivotally attached to one another by pin joints. Sleeves formed integrally with the frame members cooperate with the hook members to form the pin joints.

4 Claims, 4 Drawing Figures

ADJUSTABLE RACK FOR HANGING ARTICLES

FIELD OF THE INVENTION

The present invention relates to adjustable racks adapted to hang articles therefrom, and, more particularly, to such racks having hooks attached to a jointed frame comprised of members which are pivotally attached to one another by pin joints. Even more particularly, the present invention relates to such adjustable racks wherein the pin joints include elements formed integrally with the frame members and wherein the hooks serve as components of the pin joints.

BACKGROUND OF THE INVENTION

In order to store articles such as hats, coats, cookware and the like, various racks have been designed for hanging such articles in an orderly fashion. One type of rack includes hooks which are attached to a jointed frame. This type of rack is especially advantageous because the overall dimensions of the rack and, hence, the spacing between the hooks are adjustable. As a result, such racks can be adjusted to accommodate wide and narrow articles, as well as to fit into wide and narrow storage spaces. Additionally, the racks can be folded into a compact configuration for inexpensive shipment.

Prior to the development of the unique rack disclosed in my U.S. Pat. No. 4,287,993, racks of the type described above were usually fabricated from a variety of relatively expensive elements, such as wooden members, metal screws and the like, which necessitated the use of tools in order to assemble the racks. The rack disclosed in my prior patent includes at least two frame members, one of which is provided with an open-ended sleeve and the other of which is provided with an integrally formed pin. The pin is pivotally received in the sleeve with its free end protruding through the sleeve. The free end of the pin is frictionally engaged by a hollow hook member, which cooperates with the pin and sleeve to form a pin joint for pivotally attaching the two frame members to each other. Such a construction results in an inexpensive adjustable rack which can be advantageously made from injection molded plastic and which can be assembled in a short amount of time without the use of special tools.

Although the rack described and illustrated in my U.S. Pat. No. 4,287,993 has been marketed successfully by the assignee of the present application for a number of years, there is room for improvement. For instance, because the seam between the hook member and the sleeve is visible, the aesthetic appearance of the rack is not as clean and, hence, as pleasing as it might otherwise be.

SUMMARY OF THE INVENTION

The shortcomings of the racks described above are overcome by a new and improved adjustable rack which, like my prior rack, utilizes a pin joint to pivotally attach at least two frame members to each other. In accordance with the improvement, both of the frame members are provided with integral sleeves, one of which extends into the other for rotation relative thereto. A hook member has an integral pin which, when inserted into the outer sleeve, frictionally and/or mechanically engages the inner sleeve to form a pin joint between the two frame members. A head formed integrally with the hook member is sized, shaped and located so as to conceal the seam between the hook member and the outer sleeve, thereby giving the rack a cleaner and, hence, more aesthetically pleasing appearance.

In one embodiment, the pin frictionally engages the inner sleeve and protrudes therefrom. By providing the protruding portion of the pin with a mechanical locking device, such as a resiliently deformable bead, the hook member can be mechanically, as well as frictionally, attached to the inner sleeve, thereby improving the integrity of the pin joint.

BRIEF DESCRIPTION OF THE DRAWINGS

For a more complete understanding of the present invention, reference is made to the following description of an exemplary embodiment considered in conjunction with the accompanying drawings, in which.

DETAILED DESCRIPTION OF THE EXEMPLARY EMBODIMENT

While the present invention is applicable to any type of adjustable rack or similar device, it is especially suitable for use in connection with the type of adjustable rack disclosed in my U.S. Pat. No. 4,287,993. Thus, the present invention will be described with particular reference to the type of adjustable rack disclosed in my prior patent, the specification of which patent is incorporated herein by reference.

Figure 1:
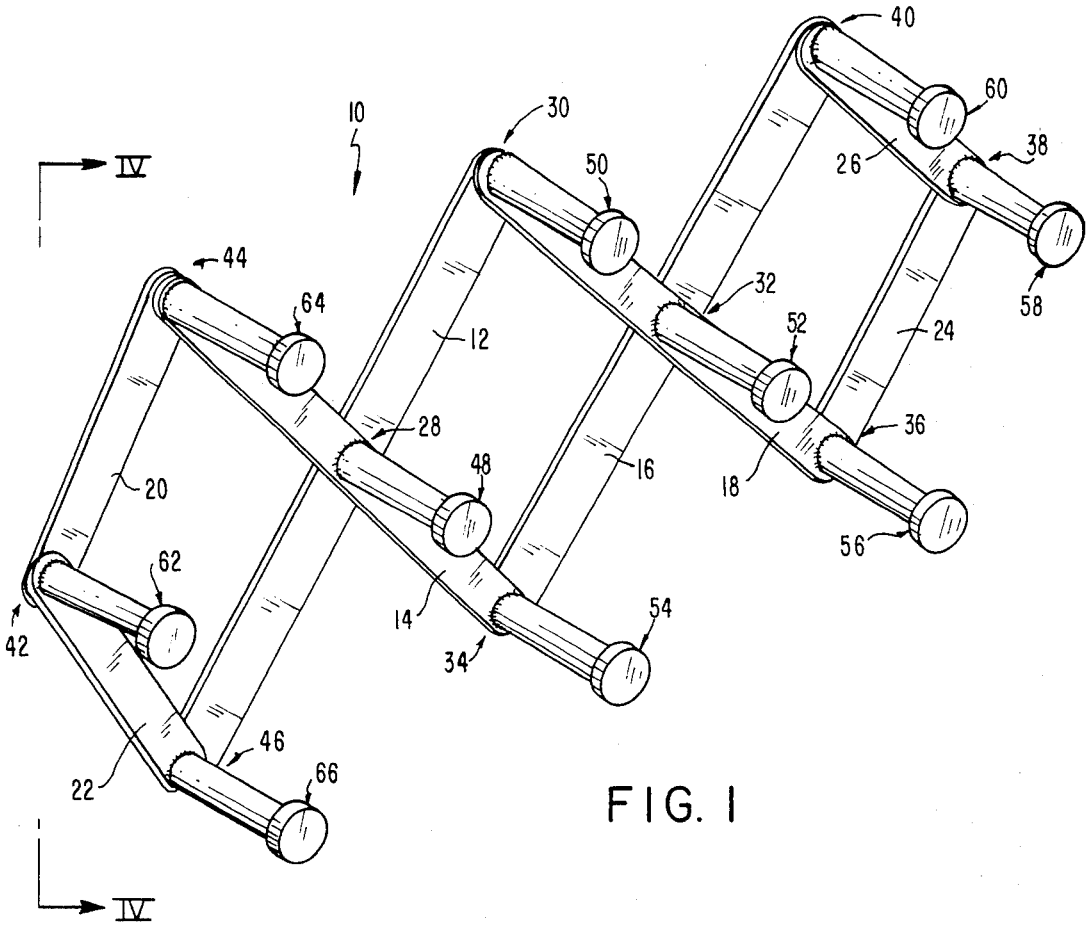
FIG. 1 is a perspective view of one embodiment of an adjustable rack constructed in accordance with the present invention.

Referring initially to FIG. 1, there is shown an adjustable rack 10 made entirely of injection molded plastic, such as pigmented polypropylene. More particularly, the rack 10 includes a first pair of inner frame members 12, 14, a second pair of inner frame members 16, 18, a first pair of outer frame members 20, 22 and a second pair of outer frame members 24, 26. The frame members 12, 14 are pivotally attached to one another by a pin joint 28. A pin joint 30 pivotally attaches the frame member 12 to the frame member 18, while the frame members 16, 18 are pivotally attached to each other by a pin joint 32. The frame members 12, 14 are pivotally attached to each other by a pin joint 34. A pin joint 36 pivotally attaches the frame member 18 to the frame member 24, which is also pivotally attached to the frame member 26 by a pin joint 38. The frame members 16, 26 are pivotally attached to each other by a pin joint 40. A pin joint 42 pivotally attaches the frame member 20 to the frame member 22, while the frame members 14, 20 are pivotally attached to each other by a pin joint 44. The frame member 12 is pivotally attached to the frame member 22 by a pin joint 46. Hook members 48, 50, 52, 54, 56, 58, 60, 62, 64, 66 are located at the pin joints 28, 30, 32, 34, 36, 38, 40, 42, 44, 46, respectively.

Figure 2:
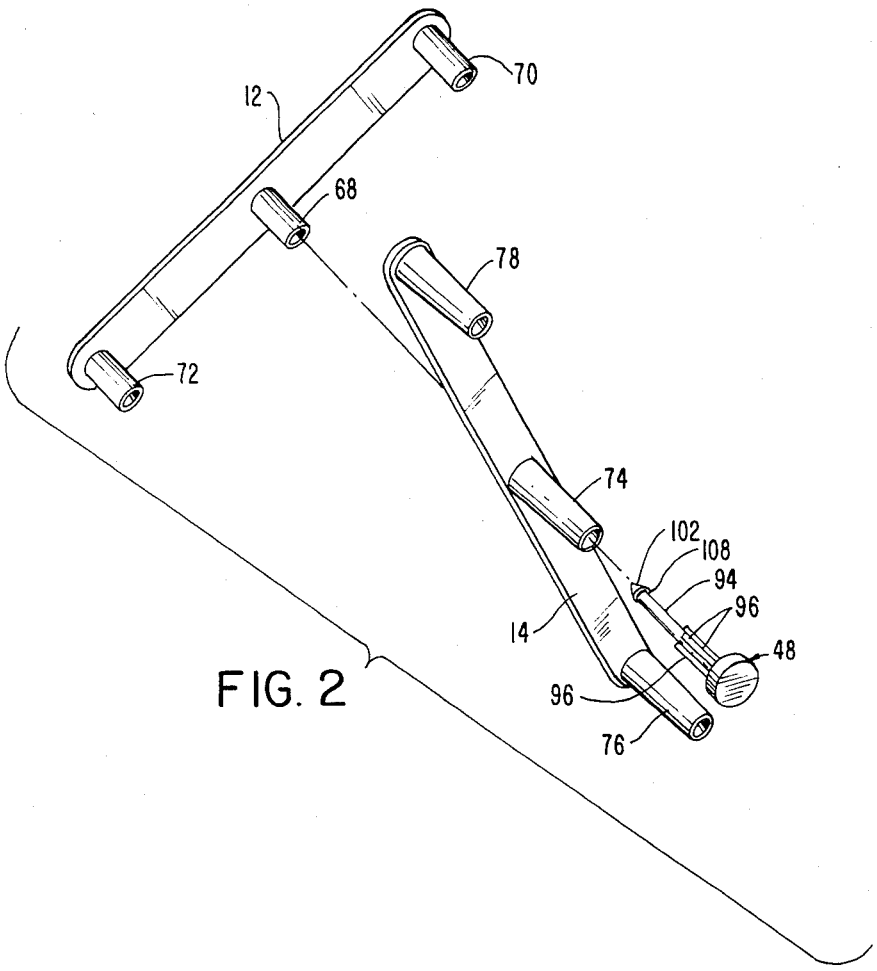
FIG. 2 is an exploded perspective view of a pair of inner frame members which are utilized by the adjustable rack shown in FIG. 1.

Referring now to FIG. 2, the frame member 12 is provided with a sleeve 68 located at its center, a sleeve 70 located at one end and a sleeve 72 located at its opposite end. The frame member 14 is provided with a sleeve 74 located its center, a sleeve 76 located at one end and a sleeve 78 located at its opposite end. The sleeve 68 has an outer diameter which is slightly less than an inner diameter of the sleeve 74 to form a snug slip fit between the sleeves 68, 74, so that the sleeve 68 can be rotatably received within the sleeve 74. The sleeves 68, 74 cooperate with the hook member 48 to form the pin joint 28 in a manner to be described in greater detail hereinafter. It should be understood that the frame members 16, 18 are essentially identical to the frame members 12, 14, respectively. It should also be understood that the sleeves 70, 72 on the frame member 12 form components of the pin joints 30, 46, respectively, while the sleeves 76, 78 on the frame member 14 form components of the pin joints 34, 44, respectively.

Figure 3:
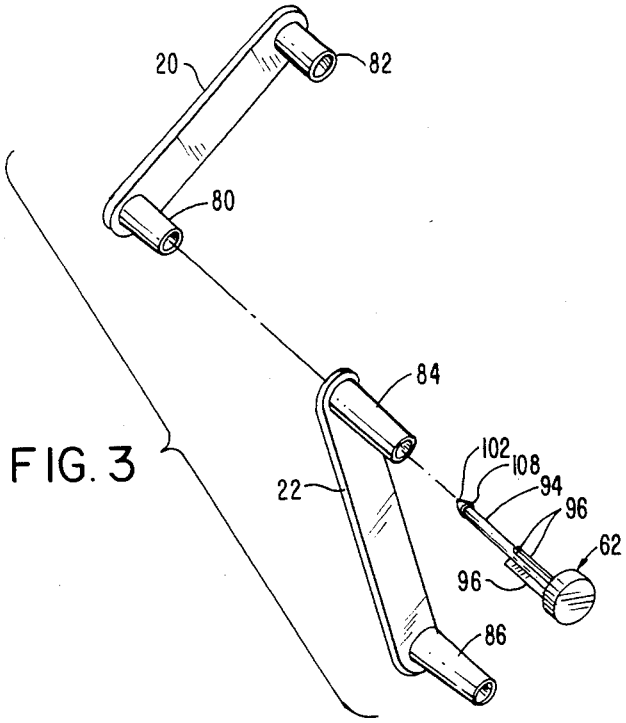
FIG. 3 is an exploded perspective view of a pair of outer frame members employed by the rack shown in FIG. 1.

With reference to FIG. 3, the frame member 20 is provided with a sleeve 80 located at one end and a sleeve 82 located at its opposite end. The frame member 22 is provided with a sleeve 84 located at one end and a sleeve 86 located at its opposite end. The sleeve 80 has an outer diameter which is slightly less than an inner diameter of the sleeve 84 to form a snug slip fit between the sleeves 80, 84, so that the sleeve 80 can be rotatably received within the sleeve 84. The sleeves 80, 84 cooperate with the hook member 62 to form the pin joint 42 in a manner described in greater detail hereinafter. It should be understood that the frame members 24, 26 are essentially identical to the frame members 20, 22, respectively. It should also be understood that the sleeve 82 on the frame member 20 forms a component of the pin joint 44, while the sleeve 86 on the frame member 22 forms a component of the pin joint 46.

Figure 4:
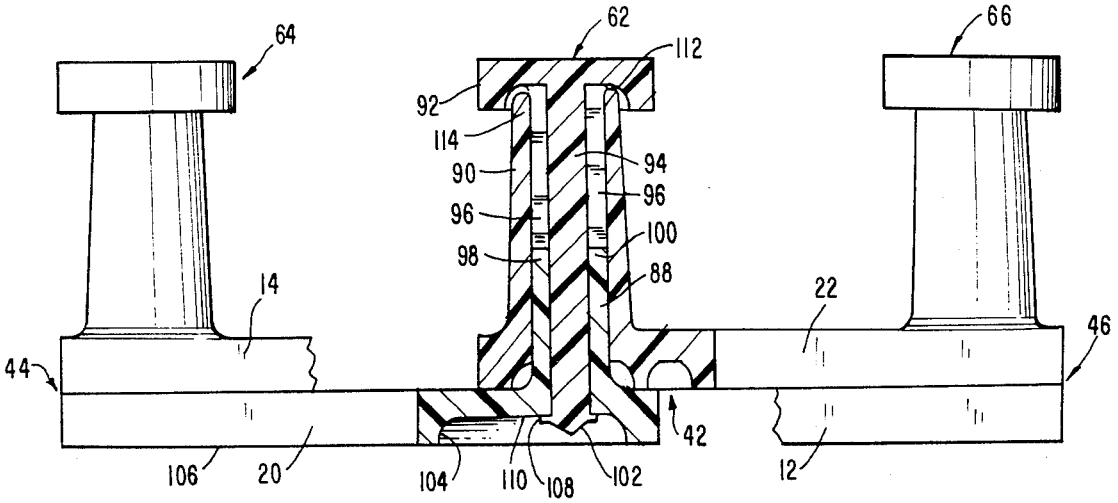
FIG. 4 is an enlarged cross-sectional view, taken along line IV—IV in FIG. 1 and looking in the direction of the arrows, of the adjustable rack illustrated in FIG. 1, portions of the rack being broken away to facilitate consideration and discussion.

With reference now to FIG. 4, the pin joint 42 includes the hook member 62, a sleeve 88 formed integrally with the frame member 20, and a sleeve 90 formed integrally with the frame member 22. The sleeve 88 has an outer diameter which is slightly less than an inner diameter of the sleeve 90 to form a snug slip fit between the sleeves 88, 90, so that the sleeve 88 can be rotated relative to the sleeve 90.

The hook member 62 has a head 92 and a pin 94, which extends into the sleeves 88, 90. The pin 94 has a diameter which is slightly less than an inner diameter of the sleeve 88 to form an interference fit between the pin 94 and the sleeve 88, so that the pin 94 frictionally engages the sleeve 88 to thereby fasten the frame members 20, 22 to each other. Ribs 96 extend radially outwardly from the pin 94 to form a snug slip fit between the pin 94 and the sleeve 90. The ribs 96 also engage a free end 98 of the sleeve 88 to axially position the pin 94 within the sleeves 88, 90. The free end 98 of the sleeve 88 is provided with a taper 100 to facilitate the insertion of the pin 94 into the sleeve 88.

The pin is long enough so that a free end 102 protrudes from the sleeve 88 into a depression 104 formed in a back surface 106 of the frame member 20. The free end 102 of the pin 94 is provided with a deformable bead 108 extending radially outwardly therefrom. Due to the resiliency of the plastic from which it is made, the bead 108 can be deformed to permit the insertion of the pin 94 into the sleeve 88. The elastic memory of the plastic permits the bead 104 to expand and assume its original shape after the pin 94 has been completely inserted through the sleeve 88. When it has expanded, the bead 108 engages a shoulder 110 formed by the depression 104 in the frame member 20 to mechanically fasten the frame members 20, 22 to each other.

The head 92 of the hook member 62 is large enough to prevent articles from slipping off of the hook 62 when the rack 10 is in use. Also, the head 92 of the hook member 62 is provided with an annular groove 112 sized and shaped to receive a free end 114 of the sleeve 90. Because the free end 114 of the sleeve 90 actually extends into the head 92 of the hook member 62, the seam between the sleeve 90 and the hook member 62 is concealed from view when the rack 10 is in use to give the rack 10 a cleaner and, hence, more aesthetically pleasing appearance.

In use, the rack 10 can be hung from a vertical support surface by any suitable technique. For instance, the rack 10 can be provided with holes adapted to receive fasteners, such as screws, for fastening the rack 10 to a wall or a door.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

I claim:

1. In a plastic rack for hanging articles therefrom, said rack including a first frame member and a second frame member pivotally attached to said first frame member by a pin joint, the improvement wherein said pin joint comprises a first sleeve formed integrally with said first frame member, a second sleeve formed integrally with said second frame member, said second sleeve extending only partially into said first sleeve and being rotatably received within said first sleeve, and a hook member extending into said first and second sleeves, said hook member including engaging means formed integrally therewith for engaging said second sleeve to thereby fasten said first frame member to said second frame member, said engaging means including a pin sized and shaped to frictionally engage said second sleeve, said pin including ribs extending radially outwardly therefrom so as to form a snug slip fit with said first sleeve and to engage a free end of said second sleeve.

2. An improved rack according to claim 1, wherein said pin has a free end which protrudes beyond said second sleeve.

3. An improved rack according to claim 2, wherein said free end of said pin includes a resiliently deformable bead sized and shaped to engage a shoulder on said second frame member to thereby mechanically fasten said second frame member to said first frame member.

4. An improved rack according to claim 3, wherein said hook member includes a head positioned adjacent to a free end of said first sleeve, said head having an annular groove sized and shaped so as to receive said free end of said first sleeve, whereby a seam formed between said hook member and said first sleeve is concealed from view by said head when said rack is in use.

* * * * *